US006123595A

United States Patent [19]

Dean

[11] Patent Number: 6,123,595

[45] Date of Patent: Sep. 26, 2000

[54] INTERCHANGEABLE CONTACT SYSTEM FOR A DOLL

[76] Inventor: Sonya K. Dean, 11320 N. Florida, Oklahoma City, Okla. 73120

[21] Appl. No.: 09/345,847

[22] Filed: Jul. 1, 1999

[51] Int. Cl.[7] ..... A63H 3/16

[52] U.S. Cl. ..... 446/100; 446/392

[58] Field of Search ..... 446/100, 219, 446/372, 389, 392, 337; 623/4, 5; 434/295, 296

[56] References Cited

U.S. PATENT DOCUMENTS 1,804,927 5/1931 Gilbert .
3,610,510 10/1971 Lowry .
3,757,465 9/1973 Barlow .
4,393,619 7/1983 Murch .
4,601,673 7/1986 Nasca .
5,498,189 3/1996 Townsend .
5,540,612 7/1996 Mendez .

*Primary Examiner*—Sam Rimell

[57] ABSTRACT

An interchangeable contact system for a doll for permitting changing of the eye color of the doll as desired includes a doll having at least one eye, each eye having an aperture, a plurality of colored lenses each having a stem insertable into the aperture, and a box for holding the lenses. In a most preferred embodiment, the stem extends outwardly from a position proximate an edge of a circular translucent colored lens. The eye of the doll includes a pupil portion surrounded by an iris portion, the iris portion including the aperture for receiving the stem. Also in a preferred embodiment, the box includes a platform having a plurality of holes for securely storing extra lenses to provide a set of various colored lenses for selective covering of the doll's eyes.

8 Claims, 1 Drawing Sheet

INTERCHANGEABLE CONTACT SYSTEM FOR A DOLL

BACKGROUND OF THE INVENTION

1. Field of the Invention

The present invention relates to dolls and more particularly pertains to a new interchangeable contact system for a doll for permitting changing of the eye color of the doll as desired.

2. Description of the Prior Art

The use of dolls is known in the prior art. More specifically, dolls heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,277,911; U.S. Pat. No. 2,208,219; U.S. Pat. No. 3,757,465; U.S. Pat. No. Des. 275,694; U.S. Pat. No. 3,364,618; and U.S. Pat. No. Des. 368,124.

While these devices fulfill their respective, particular objectives and requirements, the aforementioned patents do not disclose a new interchangeable contact system for a doll. The inventive device includes a doll having at least one eye, each eye having an aperture, a plurality of colored lenses each having a stem insertable into the aperture, and a box for holding the lenses.

In these respects, the interchangeable contact system for a doll according to the present invention substantially departs from the conventional concepts and designs of the prior art, and in so doing provides an apparatus primarily developed for the purpose of permitting changing of the eye color of the doll as desired.

SUMMARY OF THE INVENTION

In view of the foregoing disadvantages inherent in the known types of dolls now present in the prior art, the present invention provides a new interchangeable contact system for a doll construction wherein the same can be utilized for permitting changing of the eye color of the doll as desired.

The general purpose of the present invention, which will be described subsequently in greater detail, is to provide a new interchangeable contact system for a doll apparatus and method which has many of the advantages of the dolls mentioned heretofore and many novel features that result in a new interchangeable contact system for a doll which is not anticipated, rendered obvious, suggested, or even implied by any of the prior art dolls, either alone or in any combination thereof.

To attain this, the present invention generally comprises a doll having at least one eye, each eye having an aperture, a plurality of colored lenses each having a stem insertable into the aperture, and a box for holding the lenses.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new interchangeable contact system for a doll apparatus and method which has many of the advantages of the dolls mentioned heretofore and many novel features that result in a new interchangeable contact system for a doll which is not anticipated, rendered obvious, suggested, or even implied by any of the prior art dolls, either alone or in any combination thereof.

It is another object of the present invention to provide a new interchangeable contact system for a doll that may be easily and efficiently manufactured and marketed.

It is a further object of the present invention to provide a new interchangeable contact system for a doll that is of a durable and reliable construction.

An even further object of the present invention is to provide a new interchangeable contact system for a doll which is susceptible of a low cost of manufacture with regard to both materials and labor, and which accordingly is then susceptible of low prices of sale to the consuming public, thereby making such interchangeable contact system for a doll economically available to the buying public.

Still yet another object of the present invention is to provide a new interchangeable contact system for a doll which provides in the apparatuses and methods of the prior art some of the advantages thereof, while simultaneously overcoming some of the disadvantages normally associated therewith.

Still another object of the present invention is to provide a new interchangeable contact system for a doll for permitting changing of the eye color of the doll as desired.

Yet another object of the present invention is to provide a new interchangeable contact system for a doll which includes a doll having at least one eye, each eye having an aperture, a plurality of colored lenses each having a stem insertable into the aperture, and a box for holding the lenses.

Still yet another object of the present invention is to provide a new interchangeable contact system for a doll that has a selectable eye color.

Even still another object of the present invention is to provide a new interchangeable contact system for a doll that has selectable color contacts for facilitating color coordination between the doll's eye color and the color of the doll's clothing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
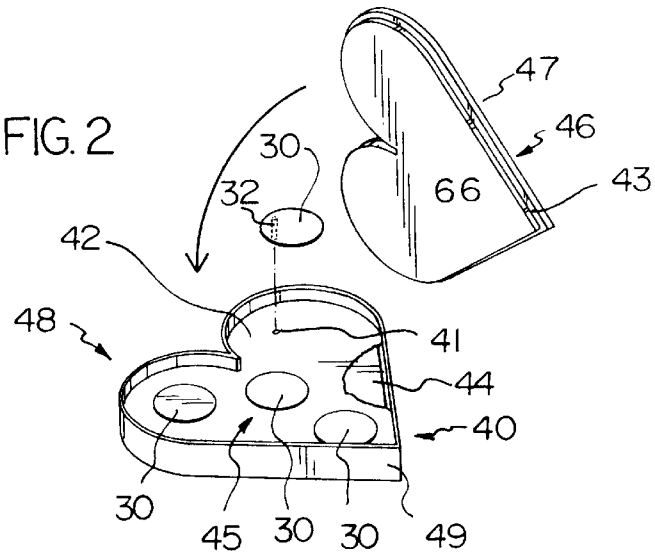
FIG. 2 is a perspective view of the storage box of the present invention.
Figure 3:
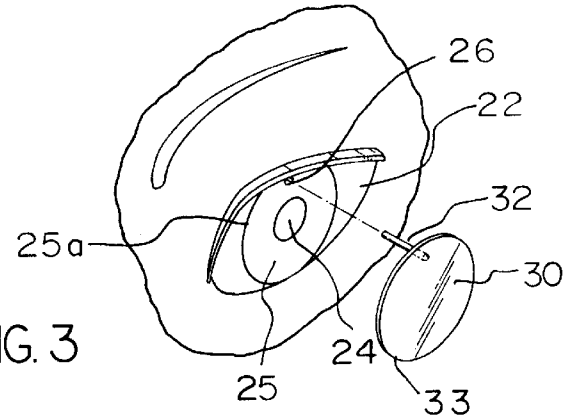
FIG. 3 is an perspective view of the lens and doll eye of the present invention.
Figure 1:
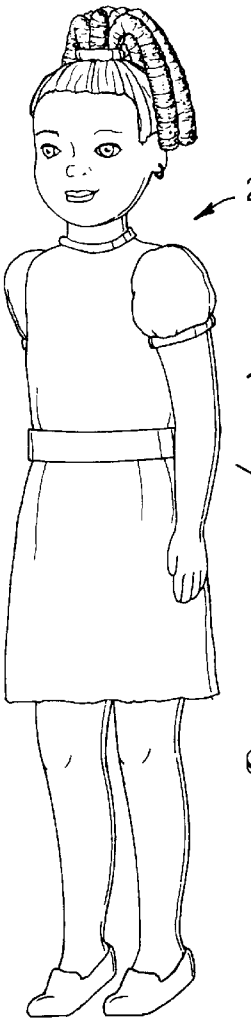
FIG. 1 is a perspective view of a new interchangeable contact system for a doll according to the present invention.

With reference now to the drawings, and in particular to FIGS. 1 through 6 thereof, a new interchangeable contact system for a doll embodying the principles and concepts of the present invention and generally designated by the reference numeral 10 will be described.

As best illustrated in FIGS. 1 through 6, the interchangeable contact system for a doll 10 generally comprises a doll 20 having at least one eye 22, a plurality of generally circular colored lenses 30 for positioning over an eye 22, and a box 40 for holding the plurality of lenses 30 when not positioned over an eye 22.

The preferred manner of coupling a lens 30 over an eye 22 is or each eye 22 to have an aperture 26 extending into the doll 20. Each lens 30 includes a stem 32 extending outwardly from the lens 30 for removable insertion into the aperture 26. The aperture 26 extends sufficiently into the doll 20 such that the lens 30 is positioned over the eye 22 when the stem 32 is fully inserted into the aperture 26. The colored lens 30 is designed to change the apparent color of the eye 22 when the lens 30 is positioned over the eye 22.

In a most preferred embodiment, the eye 22 of the doll 20 has a pupil portion 24 and a generally circular iris portion 25 surrounding the pupil portion 24. The aperture 26 is preferably positioned within the iris portion 25 near an upper edge 25A of the iris portion 25 and the stem is positioned near an edge 33 of the lens 30 such that the lens 30 is positioned to cover the iris portion 25 and the pupil portion 24 when the stem 32 is inserted into the aperture 26. Thus the center of gravity of the lens 30 is positioned below the stem 32 for facilitating proper alignment of the lens 30 over the eye 22.

While any pattern or design may be imparted onto the lens 30, each lens 30 is most preferably translucent such that the pupil portion 24 of the eye 22 is visible through the lens 30 when the lens 30 is positioned over the eye 22. It is also preferred that the lens 30 and the stem 32 have a unitary construction such that no attachment means are visible through the lens 30.

The box 40 includes a lid 46 and a bottom portion 48. platform 42 positioned in spaced relationship over a bottom interior surface 44 of the box, the platform 42 is structured to have a plurality of holes 41 extending towards the bottom interior surface 44 of the box 40. Each of the holes 41 is designed for receiving the stem 32 of one of the plurality of lenses 30 for securely storing the lenses 30 in the box 40 to prevent scratching of the lenses 30.

Preferably, the bottom portion 48 and the lid 46 each has a heart shaped outer perimeter, 49 and 47 respectively. The outer perimeter 49 of the bottom portion 48 defines an interior space 45. The lid 46 has a lip 43 such that an interior portion 66 of the lid 46 is snugly insertable into a portion of the interior space 45.

The outer perimeter 47 of the lid 46 is configured to substantially align with the outer perimeter 49 of the bottom portion 48 such that the bottom portion 48 and the lid 46 form a single outer perimeter wall 55 of the box 40 when the interior portion 66 of the lid 46 is inserted into the interior space 45.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An interchangeable contact system for a doll comprising:

a doll having an eye, said eye having an aperture therein extending into said doll;

a plurality of colored lenses, each lens having a stem extending therefrom for removable insertion into said aperture whereby said lens is positioned over said eye when said stem is fully inserted into said aperture, said colored lens being for changing the eye color of the doll;

said eye of said doll having a pupil portion and an iris portion surrounding said pupil portion; and said aperture being positioned within said iris portion.

2. The interchangeable contact system of claim 1, further comprising:

a box for holding said plurality of lenses when not positioned over one of said eyes, said box including a platform positioned in spaced relationship over a bottom interior surface of said box, said platform being structured to have a plurality of holes therein extending towards said bottom interior surface of said box, each of said plurality of holes being for receiving said stem of one of said plurality of lenses therein for storing said one of said lenses within said box.

3. The interchangeable contact system of claim 1, further comprising:

said plurality of lenses being translucent such that said pupil portion is visible through said lens when said lens is positioned over said eye.

4. The interchangeable contact system of claim 1, further comprising:

said lens and said stem having a unitary construction.

5. The interchangeable contact system of claim 2, further comprising:

said box having a lid and a bottom portion, said bottom portion and said lid each having a heart shaped outer perimeter, said outer perimeter of said bottom portion defining an interior space, said lid having a lip such that an interior portion of said lid is snugly insertable into said interior space.

6. The interchangeable contact system of claim 5, further comprising:

said outer perimeter of said lid being configured to substantially align with said outer perimeter of said bottom portion whereby said bottom portion and said lid form a single outer perimeter wall of said box when said interior portion of said lid is inserted into said interior space.

7. The interchangeable contact system of claim 1, further comprising:

said aperture within said iris portion being positioned proximate an upper edge of said iris portion; and said stem extending from an upper edge of said lens such that said lens is positioned to cover said iris portion and said pupil portion when said stem is inserted into said aperture.

8. An interchangeable contact system for a doll comprising:

a doll having an eye, said eye having an aperture therein extending into said doll;

a plurality of generally circular colored lenses, each lens having a stem extending therefrom for removable insertion into said aperture whereby said lens is positioned over said eye when said stem is fully inserted into said aperture, said colored lens being for changing the eye color of the doll;

a box for holding said plurality of lenses when not positioned over one of said eyes, said box including a platform positioned in spaced relationship over a bottom interior surface of said box, said platform being structured to have a plurality of holes therein extending towards said bottom interior surface of said box, each of said plurality of holes being for receiving said stem of one of said plurality of lenses therein for storing said one of said lenses within said box;

said eye of said doll having a pupil portion and a generally circular iris portion surrounding said pupil portion;

said plurality of lenses being translucent such that said pupil portion is visible through said lens when said lens is positioned over said eye;

said aperture being positioned within said iris portion;

said lens and said stem having a unitary construction;

said box having a lid and a bottom portion, said bottom portion and said lid each having a heart shaped outer perimeter, said outer perimeter of said bottom portion defining an interior space, said lid having a lip such that an interior portion of said lid is snugly insertable into said interior space;

said outer perimeter of said lid being configured to substantially align with said outer perimeter of said bottom portion whereby said bottom portion and said lid form a single outer perimeter wall of said box when said interior portion of said lid is inserted into said interior space;

said aperture within said iris portion being positioned proximate an upper edge of said iris portion; and said stem being positioned proximate an edge of said lens such that said lens is positioned to cover said iris portion and said pupil portion when said stem is inserted into said aperture.

* * * * *